United States Patent [19]

Knight

[11] Patent Number: 4,767,256

[45] Date of Patent: Aug. 30, 1988

[54] METHOD OF OPERATING A BOOM

[75] Inventor: David J. Knight, Cheddleton, United Kingdom

[73] Assignee: J. C. Bamford Excavators Limited, Rocester, Great Britain

[21] Appl. No.: 104,529

[22] Filed: Sep. 30, 1987

Related U.S. Application Data

[63] Continuation of Ser. No. 766,779, Aug. 16, 1985, abandoned.

[30] Foreign Application Priority Data

Aug. 18, 1984 [GB] United Kingdom ..... 8421060

[51] Int. Cl.[4] ..... E02F 3/86

[52] U.S. Cl. ..... 414/708; 91/171; 91/531; 173/43

[58] Field of Search ..... 414/708; 182/144, 141; 212/256; 91/32, 33, 529, 531, 520, 171; 173/43

[56] References Cited

U.S. PATENT DOCUMENTS

| | | | |
|---|---|---|---|
| 2,606,078 | 8/1952 | Brock | 304/29 |
| 2,881,931 | 4/1959 | Mackie | 414/708 |
| 2,990,072 | 6/1961 | Mindrum | 414/708 |
| 3,288,316 | 11/1966 | West | 214/771 |
| 3,462,103 | 8/1969 | Strom | 173/43 |
| 3,836,025 | 9/1974 | Olson | 214/77 |
| 4,037,671 | 7/1977 | Kimber et al. | 91/531 |
| 4,266,909 | 5/1981 | Langenfeld | 414/708 |
| 4,376,612 | 3/1983 | Yeou | 414/708 |

FOREIGN PATENT DOCUMENTS

| | | |
|---|---|---|
| 3116303 | 11/1982 | Fed. Rep. of Germany . |
| 1176523 | 4/1959 | France . |
| 1102963 | 2/1968 | United Kingdom . |

*Primary Examiner*—Joseph F. Peters, Jr.
*Assistant Examiner*—Thomas J. Brahan
*Attorney, Agent, or Firm*—Christie, Parker & Hale

[57] ABSTRACT

A method of operating a boom which comprises an elongate member mounted on a base for pivotal movement about a first axis transverse to the axis of the elongate member, first fluid operated power means mounted between the base and the elongate member to control raising and lowering of the member about said first axis, an implement mounted at one end of the member for pivotal movement about a second axis transverse to the axis of the elongate member, second fluid operated power means comprising a double acting ram having a cylinder and plunger slidable therein, mounted between the implement and the member to control movement of the implement about the second axis, means to feed fluid under pressure to and from the first fluid operated power means along first feed lines via a first operating valve, means to feed fluid under pressure to and from the second fluid operated power means along second feed lines via a second operating valve, a displacement means comprising a further double acting fluid operated ram connected between the member and the base to sense movement of the member about the first axis, fluid lines from the displacement means to the second fluid operated power means to transmit a signal to the second fluid operated power means to cause the second fluid operated power means to operate to maintain the orientation of the implement relative to the base as the implement is raised and lowered on the member, the method including the steps of providing fluid under pressure to the displacement means during raising of said one end of the elongate member, whereby said displacement means contributes to the raising of said one end of the member so that the design limit of the boom can be raised without having to increase the lifting capacity of the first fluid operated power means, while the orientation of the implement relative to the base can be maintained level during raising and lowering.

10 Claims, 1 Drawing Sheet

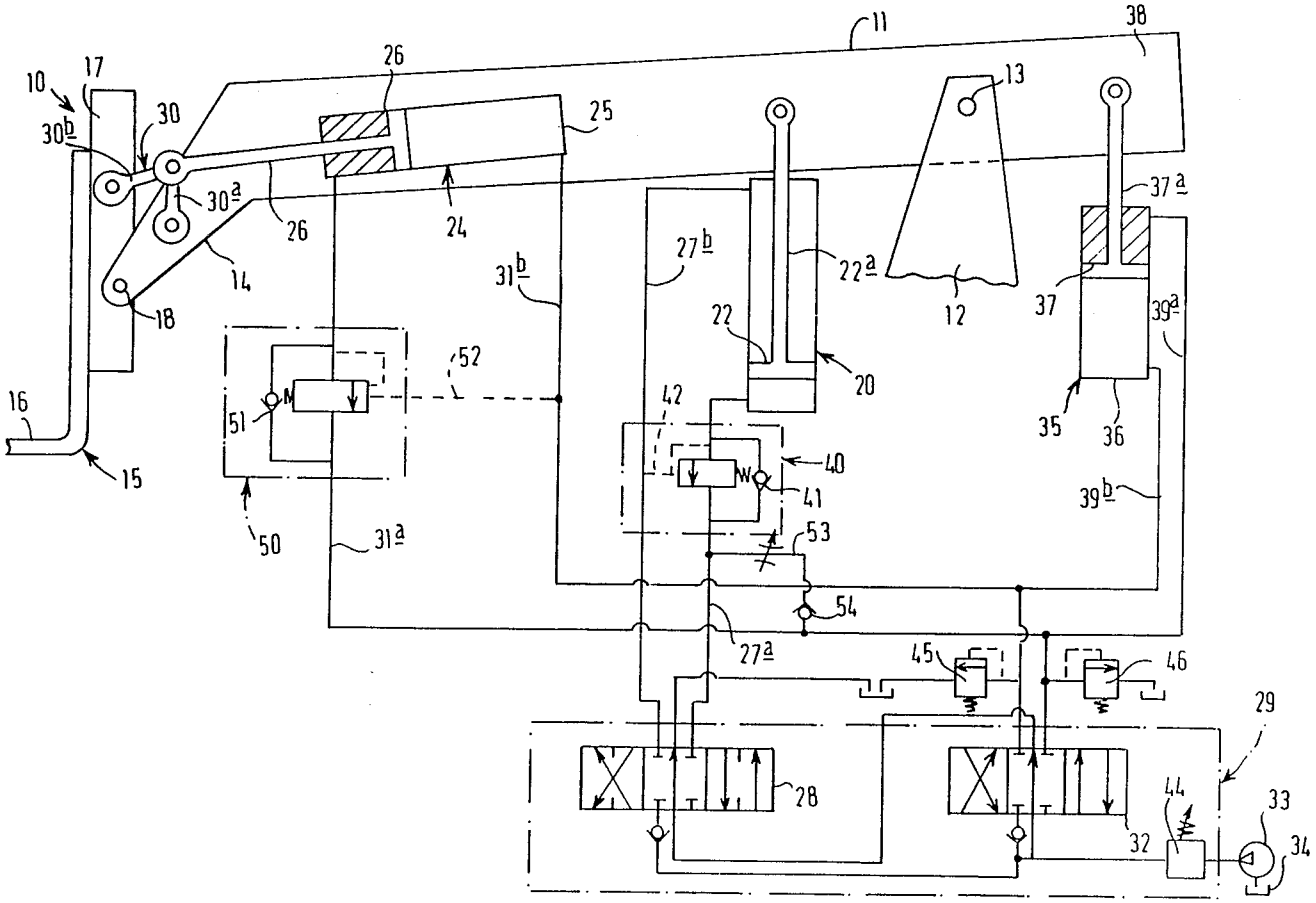
10
11
12
13
14
15
16
17
18
20
22
22a
24
25
26
27a
27b
28
29
30
30a
30b
31a
31b
32
33
34
35
36
37
37a
38
39a
39b
40
41
42
44
45
46
50
51
52
53
54

METHOD OF OPERATING A BOOM

CROSS-REFERENCE TO RELATED APPLICATIONS

This is a continuation of Ser. No. 766,779 filed Aug. 16, 1985, now abandoned.

BACKGROUND OF THE INVENTION

This invention relates to a method of operating a boom or jib (hereinafter called "a boom") which is mounted on a base, such as a tractor or wheeled vehicle such as are used on building sites and the like for the handling of loads, or a base which is fixed to or supported directly on the ground.

More particularly, the invention relates to a method of operating a boom which comprises an elongate member mounted on a base for pivotal movement about a first axis transverse to the axis of the elongate member, first fluid operated power means mounted between the base and the elongate member to control raising and lowering of the member about said first axis, an implement mounted at one end of the member for pivotal movement about a second axis transverse to the axis of the elongate member, second fluid operated power means comprising a double acting ram having a cylinder and plunger slidable therein, mounted between the implement and the member to control movement of the implement about the second axis, means to feed fluid under pressure to and from the first fluid operated power means along first feed lines via a first operating valve, means to feed fluid under pressure to and from the second fluid operated power means along second feed lines via second operating valve, a displacement means comprising a further double acting fluid operated ram connected between the member and the base to sense movement of the member about the first axis, fluid lines from the displacement means to the second fluid operated power means to transmit a signal to the second fluid operated power means to cause the second fluid operated power means to operate to maintain the orientation of the implement relative to the base as the implement is raised and lowered on the member. Such a boom will hereinafter be referred to as "of the kind specified".

Thus, where for example the implement is a pair of forks, a load supported on the forks can be maintained level relative to the base, for example, during raising and lowering.

Such booms are designed to handle loads up to a predetermined design limit. To increase the limit, it would be necessary to increase the capacity of at least the first fluid operated power means, which is not always practically possible due to restriction in available

SUMMARY OF THE INVENTION

Accordingly, it is an object of the present invention to provide a new or improved method of operating a boom of the kind specified.

According to one aspect of the invention, we provide a method of operating a boom of the kind specified comprising providing fluid under pressure to the displacement means during raising of said one end of the elongate member, whereby said displacement means contributes to the raising of said one end of the member.

Thus the design limit of the boom can be raised without having to increase the lifting capacity of the first fluid operated power means, whilst the orientation of the implement relative to the base can be maintained level during raising and lowering.

The fluid may be fed to the displacement means prior to the member beginning to lift, as fluid pressure builds up in the first hydraulic means system so that inital movement of the member is smooth, rather than jerky.

Preferably the fluid is fed under pressure to the fluid lines which connect the displacement means and the second fluid operated power means. The fluid lines may be operatively connected to said second feed lines.

In a boom of the kind specified, preferably a safety valve is incorporated in at least one of said second feed lines which feeds fluid to the second fluid operated power means during raising of said one end of the member to maintain the orientation of the implement so that in the event of a loss of pressure in the feed line upstream of the safety valve, e.g. as a result of the feed line bursting, pressure in the feed line downstream of the valve which would otherwise pass via the control valve to a drain reservoir, will not be lost in a completely uncontrolled manner which could cause sudden movement of the implement relative to the member to cause a load supported thereby to be dislodged, resulting in possibly a serious accident.

Such a valve usually permits fluid to flow freely past the valve to the second fluid operated power means during lowering of said one end of the elongate member, but prevents return of fluid from the second fluid operated power means during raising of said one end until a pilot signal is received to open the valve. Preferably the pilot signal is derived from the other of the second feed lines to the second fluid operated power means, so that in the event of a fluid pressure loss in the first mentioned second feed line between the safety valve and the operating valve, or in the other of the second feed lines, the valve closes, thus maintaining the orientation of the implement fixed relative to the boom until repairs are undertaken.

Preferably said fluid under pressure which is supplied to the displacement means is derived from fluid fed by one of the first fluid feed lines, to said first fluid operated power means, whereby the pressure of the fluid will be proportional to the load.

The first fluid operated power means may comprise a double acting ram, having a cylinder and plunger thereon.

According to a second aspect of the invention, we provide a boom of the kind specified comprising means to feed fluid under pressure to the displacement means during raising of said one end of the elongate member with said first fluid operated power means to assist raising of said one end.

Preferably, said boom includes a safety valve incorporated into the one of the second feed lines to the second fluid operated power means through which fluid is fed during raising of the one end of the member to maintain the orientation of the implement relative to the base. The safety valve may incorporate a one-way bypass to permit fluid to pass freely to the second fluid operated power means during raising of the said one end of the member, and a fluid flow path to permit fluid to pass from the second fluid operated power means back through the valve upon receipt of a pilot signal. The pilot signal may be derived from the other of said second feed lines to the second fluid operated power means through which fluid is fed to the fluid operated power means during raising of said one end of the member to maintain the orientation of the implement.

Preferably a similar safety valve is incorporated into one of the first feed lines to the first fluid operated power means through which fluid is fed to the first fluid operated power means during raising of said one end of the member.

The means to provide the fluid under pressure to the displacement means may comprise a path for fluid from the one of the first feed lines which feeds fluid to the first fluid operated power means during raising of said one end of the member, to the one of the second feed lines which feeds fluid to the second fluid operated power means during raising of said one end of the member to maintain the orientation of the implement. Said path may include a fluid flow valve to restrict the amount of fluid flowing from the first feed line to the second feed line.

BRIEF DESCRIPTION OF THE DRAWING

The invention will now be described with the aid of the accompanying drawing which is a diagrammatic view of a boom which may be operated in accordance with the invention.

DESCRIPTION OF THE PREFERRED EMBODIMENT

Referring to the drawing, a boom 10 comprises an elongate member 11 mounted on a base 12 for movement about a first horizontal axis 13 transverse to the axis of the elongate member 11.

In the present example, the base 12 comprises part of a wheeled vehicle of the type commonly known as a loader/handler, but could comprise part of a tracked vehicle, such as an excavator, or even a base fixed to or resting directly on the ground.

The member 11 carries at one end 14 an implement 15 which in the present case comprises a pair of forks 16 mounted on a bracket 17 which in turn is mounted on the one end 14 of the member 11 for pivotal movement about a second horizontal axis 18.

To effect and control movement of the member 11 relative to the base 12 and of the implement 15 relative to the member 11, the boom has a first fluid operated power means comprising a double acting hydraulic ram 20 having a cylinder 21 and plunger 22, the plunger being slidable in the cylinder 21 and a second fluid operated power means comprising a double acting hydraulic ram 24, again comprising a cylinder 25 and a plunger 26. The cylinder 21 of ram 20 is pivotally secured to the base, and a link **22*a* rigidly secured to the plunger is pivotally secured to the member 11. Thus, when the plunger 22 moves outwardly of the cylinder 21, the member 11** is raised and vice versa.

Hydraulic fluid is fed to and from the hydraulic ram 20 via first feed lines **27*a*, 27*b* through a first operating valve 28 of a valve cluster 29**.

The cylinder 25 is fixed within the member 11, and the plunger 26 thereof is rigidly secured to a link **26*a* which is pivotally secured to two arms 30*a*, 30*b*, of a link mechanism 30 which arms are in turn pivotally secured to end 14 of the member 11, and the bracket 17** respectively.

Thus when the plunger 26 is moved inwardly of the cylinder 25, the implement 15 is tipped backwards and vice versa.

Hydraulic fluid is fed under pressure to and from the ram 24 via a pair of feed lines **31*a*, 31*b* through a second operating valve 32 of the cluster 29. The valves 28, 32 are fed with fluid from a pump 33 which draws hydraulic fluid from a reservoir 34 to which fluid is returned after passing through the valves 28, 32** and the associated fluid operated apparatus.

The boom 10 includes a displacement means comprising a further double acting hydraulic ram 35 comprising a cylinder 36 in which a plunger 37 is slidably mounted. The cylinder 36 is again pivotally secured to the base 12, whilst the plunger 37 is rigidly secured to a link **37*a* which is itself pivotally connected to the elongate member 11, at the opposite end 38 to implement 15**.

Thus as end 14 of the member, and hence the implement 15, is raised, the plunger 37 will be urged into the cylinder 36 and vice versa. The cylinder 36 at each side of the plunger 37 is connected to a fluid line **39*a*, 39*b* which lines are connected with feed lines 31*a*, 31*b* respectively. When the operating valve 28 is operated, any movement of the member 11 will result in movement of the plunger 37 and hence the fluid on one side of the plunger 37 in line 39*a*, 39*b* will be pressurised. This increased pressure will be communicated to ram 24 via lines 39*a*, 39*b* and 31*a*, 31*b*, to maintain the orientation of the implement 15 relative to the base during raising or lowering of the end 14 of the member 11**.

For example, assuming that the implement 15 is raised, the pressure in line **39*b* will be increased as fluid on the side of the plunger 37 which communicates with line 39*b* will be urged from the ram 35. This increase in pressure will be transmitted to feed line 31*b* and as a result the plunger 26 will be urged from cylinder 25 so that the implement 15 will be tipped forwardly. Thus, although the implement 15 would normally become increasingly tipped forwards relative to the base, as end 14 of the member 11 is raised, as a result of the compensating movement of the plunger 26 within the cylinder 25 as a result of the fluid displaced from ram 35, the orientation of the implement 15 will be maintained relative to the base. Similarly when the member 11 is lowered, the ram 24 will tip the bucket backwards to maintain its orientation relative to the base, as fluid will be received from line 39*a* connected to the displacement means 35 and fed via line 31*a* to the front of ram 24**.

In fluid line **27*a* connected to ram 20, a safety valve 40 is incorporated which comprises a one-way by-pass 41 which permits the free flow of fluid into ram 20 along line 27*a*, to raise the end 14 of the member 11. However, the valve 40 closes when fluid flow is in the opposite direction, i.e. as the implement 15 is lowered, until a signal pilot pressure is received via a pilot line 42 from the feed line 27*b*. This pilot pressure will cause a spool or poppet within the valve 40 to be displaced so that there is a fluid flow path through the valve 40 to permit fluid to pass back through safety valve 40 to the operating valve 28 to the drain reservoir 34**.

The valve 40 is preferably of the type which (a) requires the pilot pressure to be above a predetermined minimum pressure before the flow path will be opened to permit fluid to pass from the ram 20 to the valve 28 (such as a pilot operated check valve) and preferably (b) also controls the flow through valve 40 to the control valve 28, in proportion to the actual pilot pressure.

Such valves which achieve (a) and (b) are well known and commonly used in the art and are known as counterbalance valves. Hence further description is not considered necessary.

The purpose of the safety valve 40 is to prevent the end 14 of the member 11 on which the implement 15 is mounted from falling in a totally uncontrolled manner in the event of loss of fluid pressure in line 27*a* between the valve 40 and the operating valve 28.

Usually, at least part of the feed line 27*a* between valves 40 and 28 comprises, a flexible hydraulic hose which is prone to abrasive wear and the like, which can weaken the hose and cause the hose to burst suddenly. In the absence of the valve 40, the fluid from ram 20 would pass via line 27*a* to the burst end and the end 14 of the member 11 would suddenly drop. Obviously this is very dangerous and can result in not only spillage of any load supported by the implement 15, but even in the vehicle on which boom 10 is mounted becoming unstable and tipping over.

In the event of a loss of fluid pressure in line 27*a*, as described, the weight of that part of the member 11 to the left of pivot 13, together with the weight of the implement 15 and any load carried thereby, will tend to urge the plunger 22 further into cylinder 21 which movement will not be resisted by fluid pressure in line 27*a* due to the burst. Thus such movement will cause the fluid pressure in the line 27*b* to drop and thus the pilot pressure in line 42 will also drop and hence valve 40 will immediately close. Hence there will no longer be an escape for the fluid so that further downward movement of the implement 15 will be arrested. Even if the valve 40 fails to stop the flow of fluid therethrough altogether, the implement 15 will only be lowered slowly towards the ground at a rate determined entirely upon the rate of fluid flow permitted through valve 40.

Line 31a connected to ram 24 also has a safety valve 50 of the counterbalanced type, comprising a by-pass 51 to permit the free flow of fluid to the ram 24, but prevent the free flow of fluid from ram 24 until a pilot pressure is received from feed line 31*b* along line 52. Thus again any sudden loss in fluid pressure in the feed line 31*a* between the valve 50 and the operating valve 32, will cause valve 50 to close and thereby arrest any forward tipping movement of the implement 15.

The lifting capacity of a boom as hereinbefore described would be governed by the lifting capacity of the ram 20 under normal circumstances. To increase the lifting capaicty of the boom 10, normally it would be required to change the ram 20 with a ram of greater lifting capacity. However, in accordance with the invention, means are provided to assist the ram 20 in raising the end 14 of the member 11.

A path for fluid under pressure is provided from the line 27a along a feed line 53 through a one-way check valve 54, to lines 31*a*, 39*a* which are connected to rams 24,35. However, valve 54 will only open if the pressure in lines 31*a*, 39*a* is not greater than that in line 53.

When it is required to raise the end 14 of the member 11, valve 28 is operated, to raise pressure in line 27*a* which is communicated via check valve 41 to the ram 20. This pressure is at the same time transmitted via line 53 and valve 54 to line 39*a*.

The fluid from line 27*a* will pass to line 39*a* which is connected to the cylinder 36 of ram 35 above the plunger, so that this increase in pressure will force the plunger 37 inwardly of the cylinder.

The pressure of fluid acting on the underside of plunger 22 will build up before lifting commences. At the same time the fluid in line 27*b* will be connected through valve 28 to the drain reservoir 34 and so will not resist upward movement of the plunger.

As movement commences, fluid will be forced out of cylinder 36 along lines 39*b*, 31*b* to act on the plunger 26 which will move to the left as seen in the drawings. This increase in pressure in line 31*b* will be communicated to valve 50 as a pilot pressure to open valve 50 to permit fluid to flow from the left hand side of cylinder 25, again as seen in the drawings, through valve 50.

As the ram 35 is connected to the opposite side of the axis 13 to the lifting ram 20, the downward movement of the plunger 37 will assist the upward movement of plunger 22 of ram 20 in raising the implement 15.

Of course, the resultant increase in pressure in line 31*a* will be communicated to ram 24, but this will not affect operation of the self-levelling feature of the boom 10 as fluid can only escape from the ram 24 at a rate determined by the movement of plunger 37 within the ram 35. On lowering of the implement 15, the fluid being urged from ram 20 through safety valve 40 will similarly be communicated to line 31*a* and will thus oppose and thus control movement of the member 11.

It will be appreciated that when operating valve 28 is operated to cause lifting of the end 14 of the member 11, it will take a short time for sufficient fluid pressure to the built up in ram 20 below the plunger 22 to actuate lift. As the pressure builds up, before lifting commences the increased pressure will be communicated via lines 53, 39*a*, to ram 35.

This arrangement considerably assists in ensuring that initial upward movement of end 14 of member 11 is smooth, rather than jerky, whatever the load.

Further, by deriving the flow of fluid under pressure to the displacement ram 35, from one of the feed lines 27*a*, 27*b*, the pressure of this fluid will be proportional to the load, so that the assistance given to ram 20 by ram 35 will depend on the load.

It has been found that in such an arrangement, not only is the lifting capacity of the boom 10 considerably enhanced so that greater loads than can otherwise be handled by the boom are handled but, parallel lifting of the forks 16 is achieved, whilst providing protection against loss of pressure, due to the safety valves 40, 50.

Further pressure relief devices are provided to limit the pressure of fluid in the system.

A main relief valve 44 is provided in the cluster 29 to limit the fluid pressure in any line communicating with the pump 33, and a pressure release valve 45, 46, is provided for each of the lines 31*b*, 39*b*, and 31*a*, 39*a* respectively.

Many modifications are possible to the arrangement described without departing from the scope of the invention.

Whereas as described, the boom comprises a single elongate member 11 in which ram 24 is mounted internally, if desired the boom could comprise a jib having one or more elongate arms, and the ram 24 may be mounted externally.

Whereas the implement 15 described is a pair of forks, of course the invention may be applied to any other implement in which it is required to maintain the orientation of the implement during lifting and lowering of the member 11. For example, the implement may comprise a loader bucket.

Although as described, the first fluid operated means comprises a single ram 20, in a practiced arrangement it is envisaged that two such rams 20 would be provided and similarly for the displacement means to comprise a pair of rams such as ram 35.

In the embodiment described, the fluid to increase the pressure in line 31*a* during raising of the boom is derived from line 27*a* connected to the lifting ram 20, but if desired this fluid may be derived directly from the pump 33 for example, or from any other suitable source, although in this case, the pressure of fluid fed to the displacement means, would not necessarily be proportional to the load.

What is claimed is:

1. The method of operating a boom comprising an elongate member mounted on a base for pivotal movement about a first axis transverse to the axis of the elongate member, first fluid operated power means mounted between the base and the elongate member to control raising and lowering of the member about said first axis, an implement mounted at one end of the member, in an orientation relative to the base, for pivotal movement about a second axis transverse to the axis of the elongate member, second fluid operated power means comprising a double acting ram having a cylinder and plunger slidable therein, mounted between the implement and the member to control movement of the implement about the second axis, mean to feed fluid under pressure to and from the first fluid operated power means along first feed lines via a first operating valve, means to feed fluid under pressure to and from the second fluid operated power means along second feed lines via a second operating valve, a displacement means comprising a further double acting fluid operated ram having a cylinder and plunger slidable therein, the ram being connected between the member and the base so that the plunger is moved relative to the cylinder as the implement is raised and lowered on the elongate member so that the displacement means thus senses movement of the member about the first axis in response to both raising and lowering of the member, a first fluid line connecting one side of the plunger of the displacement means to one side of the plunger of the second fluid operated power means and a second fluid line connecting the other side of the plunger of the displacement means with the other side of the plunger of the second fluid operated means whereby the pressures on each of the sides of the plunger of the displacement means are proportional to the pressures on the corresponding sides of the plunger of the second fluid operated power means to which the respective sides of the plunger of the displacement means are connected, whereby upon movement of the elongate member by the first fluid operated power means, a signal is transmitted from the displacement means to the second fluid operated power means to cause the second fluid operated power means to operate to maintain the orientation of the implement relative to the base as the implement is raised and lowered by the member, the method comprising the step of increasing the pressure of fluid in said first fluid line between the displacement means and the second fluid operated power means during raising of the implement by the elongate member so that said displacement means contributes to the raising of said one end of the member while the displacement means senses movement of the member and causing the second fluid operated power means to maintain said orientation of the implement relative to the base in response to the sensed movement of the elongate member.

2. A method according to claim 1 wherein the fluid is fed under pressure to the fluid lines which connect the displacement means and the second fluid operated power means.

3. A method according to claim 1 wherein a safety valve is incorporated in at least one of said second feed lines which feeds fluid to the second fluid operated power means during raising of said one end of the member to maintain the orientation of the implement, the valve permitting fluid to flow freely past the valve to the second fluid operated power means during lowering of said one end of the elongate member, but preventing return of fluid from the second fluid operated power means during raising of said one end until a pilot signal is received to open the valve.

4. A method according to claim 1 wherein the fluid under pressure which is supplied to the displacement means is derived from fluid fed by one of said first fluid feed lines, to said first fluid operated power means, whereby the pressure of the fluid will be proportional to the load.

5. A boom of the type comprising an elongate member mounted on a base for pivotal movement about a first axis transverse to the axis of the elongate member, first fluid operated power means mounted between the base and the elongate member to control raising and lowering of the member about said first axis, an implement mounted at one end of the member, in an orientation relative to the base, for pivotal movement about a second axis transverse to the axis of the elongate member, second fluid operated power means comprising a double acting ram having a cylinder and plunger slidable therein, mounted between the implement and the member to control movement of the implement about the second axis, means to feed fluid under pressure to and from the first fluid operated power means along first feed lines via a first operating valve, means to feed fluid under pressure to and from the second fluid operated power means along second feed lines via a second operating valve, a displacement means comprising a further double acting fluid operated ram having a cylinder and plunger slidable therein, the ram being connected between the member and the base so that the plunger is moved relative to the cylinder as the implement is raised and lowered on the elongate member so that the displacement means thus senses movement of the member about the first axis in response to both raising and lowering of the member, a first fluid line connecting one side of the plunger of the displacement means to one side of the plunger of the second fluid operated power means and a second fluid line connecting the other side of the plunger of the displacement means with the other side of the plunger of the second fluid operated means whereby the pressures on each of the sides of the plunger of the displacement means are porportional to the pressures on the corresponding sides of the plunger of the second fluid operated power means to which the respective sides of the plunger of the displacement means are connected, whereby upon movement of the elongate member by the first fluid operated power means, a signal is transmitted from the displacement means to the second fluid operated power means to cause the second fluid operated power means to operate to maintain the orientation of the implement relative to the base as the implement is raised and lowered by the member, the boom further comprising means for increasing the pressure of fluid in said first fluid line between the displacement means and the second fluid operated power means during raising of the implement by the elongate member so that said displacement means contributes to the raising of said one end of the member while the displacement means senses movement of the member and causes the second fluid operated power means to maintain said orientation of the implement relative to the base in response to the sensed movement of the elongate member.

6. A boom according to claim 5 wherein the boom includes a safety valve incorporated into the one of the second feed lines to the second fluid operated power means through which fluid is fed during raising of said one end of the member to maintain the orientation of the implement relative to the base, the safety valve incorporating a one-way by-pass to permit fluid to pass freely to the second fluid operated power means during raising of the said one end of the member, and a fluid flow path to permit fluid to pass from the second fluid operated power means back through the valve upon receipt of a pilot signal.

7. A boom according to claim 6 wherein the pilot signal is derived from the other of said second feed lines to the second fluid operated power means through which fluid is fed to the fluid operated power means during raising of said one end of the member to maintain the orientation of the implement.

8. A boom according to claim 7 wherein a similar safety valve is incorporated into one of the first feed lines to the first fluid operated power means through which fluid is fed to the first fluid operated power means during raising of said one end of the member.

9. A boom according to claim 5 including means to provide increased fluid pressure comprising a path for fluid from the one of the first feed lines which feeds fluid to the first fluid operated power means during raising of said one end of the member, to the one of the second feed lines which feeds fluid to the second fluid operated power means during raising of said one end of the member to maintain the orientation of the implement.

10. A boom according to claim 9 wherein the path includes a fluid flow valve to restrict the amount of fluid flowing from the first feed line to the second feed line.

* * * * *

UNITED STATES PATENT AND TRADEMARK OFFICE

CERTIFICATE OF CORRECTION

PATENT NO. : 4,767,256

DATED : August 30, 1988

INVENTOR(S) : David J. Knight

It is certified that error appears in the above-identified patent and that said Letters Patent is hereby corrected as shown below:

In the Specification

Column 1, Line 54, after "available" insert -- space. --.
Column 2, Line 5, change "inital" to -- initial --.
Column 5, Line 31, change "by-pass" to -- bypass --.
Column 5, Line 42, change "capaicty" to -- capacity --.
Column 6, Line 3, change "left hand" to -- left-hand --.
Column 6, Line 21, before "built" change "the" to -- be --.
Column 7, Line 19, change "mean" to -- means --.
Column 9, Line 7, change "by-pass" to -- bypass --.

Signed and Sealed this

Twenty-first Day of March, 1989

*Attest:*

*Attesting Officer*

DONALD J. QUIGG

*Commissioner of Patents and Trademarks*